US011105196B2

(12) United States Patent
Haslanger et al.

(10) Patent No.: US 11,105,196 B2
(45) Date of Patent: Aug. 31, 2021

(54) LEAK DETECTION SYSTEMS AND METHODS FOR COMPONENTS OF A MINERAL EXTRACTION SYSTEM

(71) Applicant: Cameron International Corporation, Houston, TX (US)

(72) Inventors: Jonathan Haslanger, Kenner, LA (US); Vikas Rakhunde, Cypress, TX (US); Ian McDaniel, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 169 days.

(21) Appl. No.: 16/295,997

(22) Filed: Mar. 7, 2019

(65) Prior Publication Data

US 2020/0284142 A1 Sep. 10, 2020

(51) Int. Cl.

| | |
|---|---|
| ***E21B 47/117*** | (2012.01) |
| ***E21B 33/02*** | (2006.01) |
| ***E21B 43/01*** | (2006.01) |
| ***E21B 33/037*** | (2006.01) |
| ***E21B 47/098*** | (2012.01) |

(52) U.S. Cl.

CPC ..... *E21B 47/117* (2020.05); *E21B 33/037* (2013.01); *E21B 43/0122* (2013.01); *E21B 47/098* (2020.05)

(58) Field of Classification Search

CPC ..... E21B 47/10; E21B 47/117; E21B 33/02; E21B 33/03; E21B 33/0355; E21B 33/06

See application file for complete search history.

(56) References Cited

U.S. PATENT DOCUMENTS

| | | | | |
|---|---|---|---|---|
| 4,116,044 | A * | 9/1978 | Garrett | E21B 33/035 73/40.5 R |
| 4,152,926 | A * | 5/1979 | Hasha | E21B 47/117 73/46 |
| 4,998,435 | A * | 3/1991 | Miller | E21B 47/117 73/40.7 |
| 5,209,105 | A * | 5/1993 | Hasha | G01M 3/223 73/46 |
| 8,347,983 | B2 * | 1/2013 | Hoyer | E21B 33/13 175/22 |
| 9,127,511 | B2 * | 9/2015 | Orbell | E21B 17/085 |
| 10,036,227 | B2 * | 7/2018 | Leuchtenberg | E21B 33/06 |
| 2019/0093445 | A1 * | 3/2019 | Kulkarni | E21B 34/02 |

* cited by examiner

*Primary Examiner* — Kenneth L Thompson
(74) *Attorney, Agent, or Firm* — Jeffrey D. Frantz

(57) ABSTRACT

A leak detection system includes an annular housing that defines a bore, a constriction with the bore, and a channel extending radially-outwardly from the bore and positioned upstream of the constriction. The leak detection system also includes a sensor positioned outside of the bore and fluidly coupled to the channel, wherein the sensor is configured to detect a leaked fluid within the bore.

19 Claims, 5 Drawing Sheets

LEAK DETECTION SYSTEMS AND METHODS FOR COMPONENTS OF A MINERAL EXTRACTION SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, mineral extraction systems are often employed to access and extract the resource. These systems may be located onshore or offshore depending on the location of a desired resource. Such systems generally include various valves (e.g., gate valves, ball valves) and other types of fluid and/or pressure control equipment. For example, a pressure control equipment (PCE) stack may be mounted above a wellhead to protect other surface equipment from surges in pressure within a wellbore during intervention operations.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
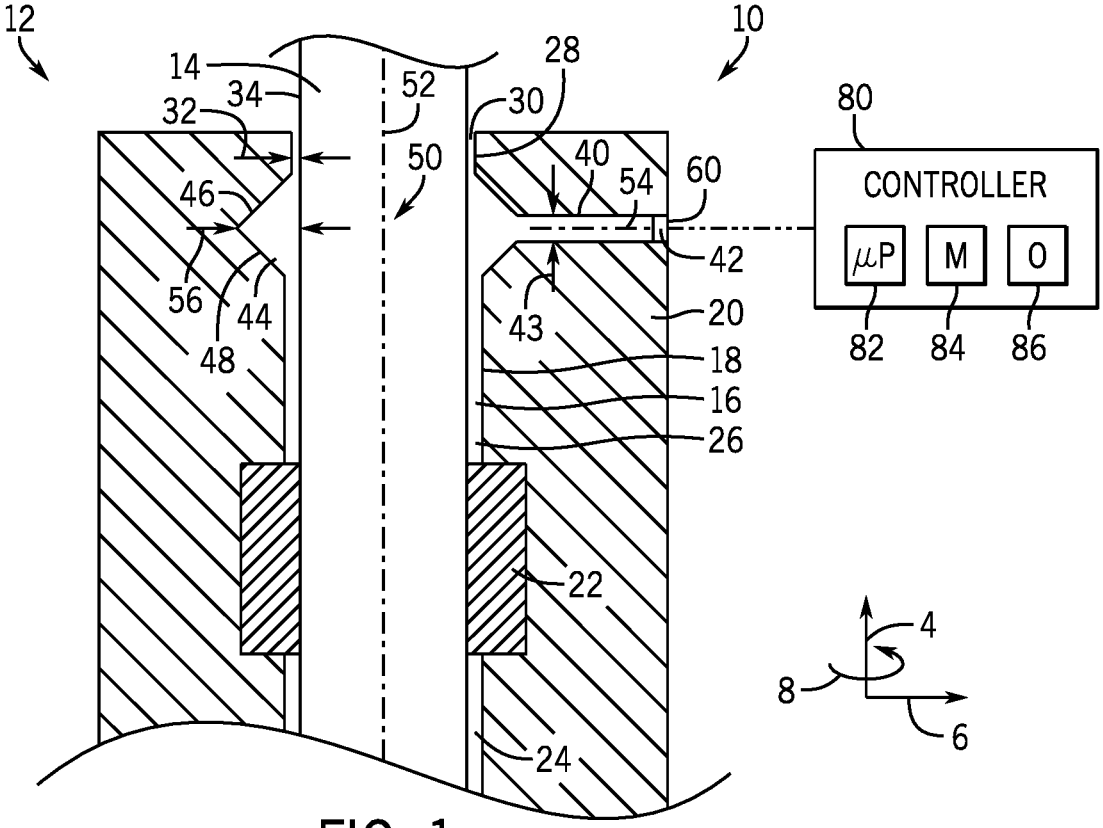
FIG. 1 is a side cross-sectional view of a leak detection system for a component of a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments generally relate to leak detection systems and methods for components of a mineral extraction system. In particular, a leak detection system may include an annular housing that defines a bore having a constriction (e.g., region of reduced diameter within the bore). The annular housing may also include at least one channel that extends radially-outwardly from the bore, and each channel includes or is otherwise fluidly coupled to a respective sensor that is capable of detecting the presence of a leaked fluid within the bore (e.g., via pressure changes). As discussed in more detail below, these features may facilitate detection of a leak around a rod as the rod moves within the bore. In the present disclosure, a rod may be any of a variety of rigid or flexible (e.g., spoolable) cylindrical or tubular structures (e.g., conduits or tubing), such as a valve stem, wireline, Streamline™, slickline, coiled tubing, or sucker rod.

The leak detection system may be used in any of a variety of valves of the mineral extraction system. For example, the leak detection system may be used in a gate valve to detect a leak around a reciprocating valve stem that drives a gate of the gate valve between open and closed positions. Similarly, the leak detection system may be used in a ball valve to detect a leak around a rotating valve stem that drives a ball of the ball valve between open and closed positions. It should be appreciated that the leak detection system may be used in valves of a wellhead, stack equipment (e.g., a "Christmas tree"), and/or surface equipment of the mineral extraction system.

As another example, the leak detection system may be used in a pressure control equipment (PCE) stack that may be coupled to and/or positioned vertically above a wellhead during various intervention operations, such as wireline or coil tubing operations in which a tool supported on a rod, such as a wireline, slickline, conduit, or tubing, is lowered through the PCE stack to enable inspection and/or maintenance of a well. The PCE stack includes components, such as a stuffing box, that seal about the wireline or other rod as it moves relative to the PCE stack. Thus, the leak detection system may be positioned vertically above the stuffing box to detect a leak around the wireline or other rod as it moves relative to the PCE stack.

With the foregoing in mind, FIG. 1 is a side cross-sectional view of an embodiment of a leak detection system 10 for a component 12 of a mineral extraction system. To facilitate discussion, the leak detection system 10 and related features may be described with reference to an axial axis or direction 4 (e.g., vertical axis or direction), a radial axis or direction 6, and/or a circumferential axis or direction 8. As shown, a rod 14 (e.g., movable rod) is positioned within a bore 16 defined by a radially-inner wall 18 (e.g., annular wall) of a housing 20 (e.g., annular housing). The rod 14 may move (e.g., reciprocate and/or rotate) within the bore 16 relative to the housing 20. In the illustrated embodiment, the housing 20 is a one-piece structure to facilitate discussion; however, the housing 20 may include multiple sections that are coupled to one another (e.g., via one or more fasteners, such as bolts; via a threaded interface).

As shown, the housing 20 supports a packer 22 (e.g., annular packer, annular elastomer seal, or any other suitable annular sealing device, such as a grease tube that may be filled with grease to seal against a wireline [e.g., braided wireline]) that contacts and seals against the rod 14 (e.g., forms a circumferential seal about the rod 14). The packer 22 may enable movement of the rod 14 through the bore 16 relative to the housing 20, while also blocking a flow of fluid (e.g., gas, liquid) from a high pressure portion 24 of the bore 16 to a low pressure portion 26 of the bore 16.

The radially-inner wall 18 of the housing 20 includes a constriction portion 28 that extends radially-inwardly to define a constriction 30 (e.g., region of reduced diameter within the bore 16). When the rod 14 is positioned within the housing 20, the constriction 30 is an annular gap between a radially-outer wall 34 of the rod 14 and the constriction portion 28 of the radially-inner wall 18 of the housing 20, and the constriction 30 has a radial distance 32 that is reduced compared to region(s) of the bore 16 that are upstream from the constriction 30 (e.g., closer to the packer 22). In some embodiments, the constriction portion 28 may contact the rod 14 without sealing against the rod 14.

The housing 20 further includes a channel 40 (e.g., radially-extending channel; flow path; leak detection path) that fluidly couples the bore 16 to a sensor 42 (e.g., flow sensor, pressure sensor). In operation, the constriction 30 may divert fluid that leaks across the packer 22 from the high pressure portion 24 of the bore 16 to the low pressure portion 26 of the bore 16 into the channel 40 to facilitate detection by the sensor 42. The fluid that leaks across the packer 22 from the high pressure portion 24 of the bore 16 to the low pressure portion 26 of the bore 16 may be referred to herein as "leaked fluid."

The housing 20 may have various configurations to facilitate diversion of the leaked fluid into the channel 40 and/or detection of the leaked fluid by the sensor 42. For example, the channel 40 may have a diameter 43, such that a total cross-sectional area of the channel 40 is greater than a total cross-sectional area of the constriction 30 (e.g., annular gap about the rod 14). In some embodiments, the radially-inner wall 18 of the housing 20 may define a cavity 44 (e.g., region of expanded diameter within the bore 16) upstream of the constriction portion 28 (e.g., closer to the packer 22). In such cases, the radially-inner wall 18 of the housing 20 may include a first tapered portion 46 and a second tapered portion 48 that define the cavity 44. The cavity 44 may be positioned at an intersection 50 between the bore 16 and the channel 40. In particular, the cavity 44 may be axially aligned with the channel 40 and may be positioned to circumferentially surround the intersection 50 between a longitudinal axis 52 of the bore 16 and a longitudinal axis 54 of the channel 40. Thus, the leaked fluid may flow into and/or collect in the cavity 44, and then the leaked fluid may flow into the channel 40. When the rod 14 is positioned within the housing 20, the cavity 44 is an annular gap between the radially-outer wall 34 of the rod 14 and the first tapered portion 46 and the second tapered portion 48 of the radially-inner wall 18 of the housing 20, and the cavity 44 has a maximum radial distance 56 that is expanded compared to the radial distance 32 of the constriction 30 and/or compared to region(s) of the bore 16 that are upstream from the cavity 44 (e.g., closer to the packer 22).

Advantageously, the sensor 42 is positioned outside of the bore 16, which may reduce interference due to movement of the rod 14 within the bore 16. Thus, the sensor 42 may accurately and reliably detect the presence of the leaked fluid. For example, in the illustrated embodiment, the sensor 42 is positioned at an end portion 60 (e.g., radially-outer end portion) of the channel 40. However, it should be appreciated that the sensor 42 may be positioned in other locations, such as a chamber that extends from or is fluidly coupled to the end portion 60 of the channel 40. Furthermore, the sensor 42 may be positioned within and supported by the housing 20, or the sensor 42 may be in a separate housing that is coupled to the housing 20 (e.g., via one or more fasteners, such as bolts).

Figure 2:
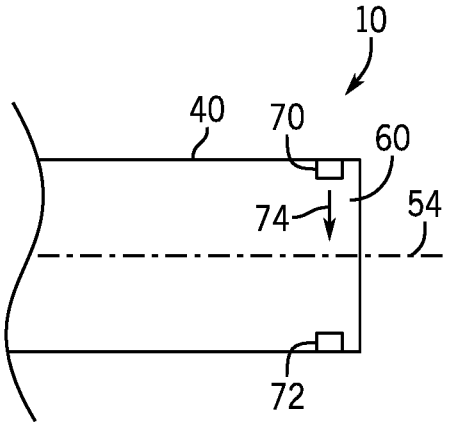
FIG. 2 is side cross-sectional view of a sensor within a channel of the leak detection system of FIG. 1, in accordance with an embodiment of the present disclosure.
Figure 3:
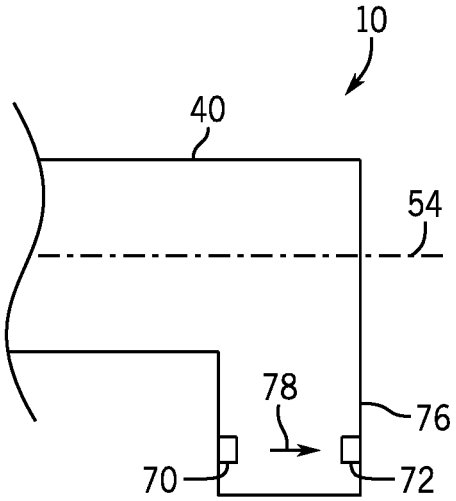
FIG. 3 is a side cross-sectional view of a sensor within a chamber that is fluidly coupled to the channel of the leak detection system of FIG. 1, in accordance with an embodiment of the present disclosure.

The sensor 42 may be any type of sensor that is capable of detecting the leaked fluid (e.g., via a change in pressure and/or a change in a fluid present in the channel 40). For example, in the absence of the leaked fluid, the sensor 42 may be exposed to ambient air at a first pressure (e.g., ambient atmospheric pressure). However, in the presence of the leaked fluid, the sensor 42 may be exposed to the leaked fluid and/or detect a second pressure that is greater than the first pressure. With the foregoing in mind, FIGS. 2 and 3 provide non-limiting examples of sensors 42 that may be used in the leak detection system 10 of FIG. 1. In FIG. 2, the sensor 42 may be an acoustic sensor or an optical sensor that is positioned at or proximate to the end portion 60 of the channel 40. The sensor may include an emitter 70 that emits waves (e.g., sound or light) toward a detector 72, as shown by arrow 74. Characteristics of the waves (e.g., velocity, amplitude) received at the detector 72 may vary in the presence of the leaked fluid (e.g., as compared to the ambient air), thereby enabling detection of the leaked fluid. As shown, the sensor 42 is positioned outside of the bore 60 and the emitter 70 is oriented to emit the waves cross-wise (e.g., angled, such as orthogonal) to the longitudinal axis 54 of the channel 40. Accordingly, the movement of the rod 14 within the bore 16 may not interfere with the measurements obtained by the sensor 42.

In FIG. 3, the sensor 34 is positioned within in a chamber 76 that extends from the end portion 60 of the channel 40. The sensor 42 may be an acoustic sensor or an optical sensor having the emitter 70 that emits waves toward the detector 72, as shown by arrow 78. As noted above, characteristics of the waves received at the detector 72 may vary in the presence of the leaked fluid. This configuration may also facilitate use of the sensor 42 as a level sensor to detect a level of liquid that accumulates within the chamber 76. It should be appreciated that the emitter 70 and the detector 72 may be positioned adjacent to one another, and the detector 72 may then detect the waves after the waves are reflected by the fluid and/or an opposed surface.

It should be appreciated that the sensor 42 may be positioned in any of a variety of locations, including any surface of the channel 40, any surface of the chamber 76, and/or in a separate housing that is coupled to the housing 20 (e.g., via one or more fasteners, such as bolts). Furthermore, the sensor 42 may be any of a variety of flow, pressure, and/or mechanical sensors, such as a manometer, a flapper sensor, a float sensor, a reed switch, or a combination thereof. For example, a flapper sensor may include a flap (e.g., hinged or biased member, such as a plate) that is positioned at the end portion 60 of the channel 40. The leaked fluid may exert a force on and cause movement of the flap, and the movement of the flap may activate a switch (e.g., a reed switch) or be otherwise detected (e.g., via a strain gauge). As another example, a float sensor may include a permanent magnet sealed inside of a buoyant element and positioned within the chamber 76. As the chamber 76 fills with liquid, the permanent magnet rises within the chamber 76 and may activate a switch (e.g., a reed switch) or otherwise be detected (e.g., via magnetostrictive wire).

Returning the FIG. 1, the sensor 42 may be communicatively coupled to a controller 80 (e.g., electronic controller) that includes a processor 82 and a memory device 84. The processor 82 may receive and process the signals from the sensor 42 to identify the absence and/or the presence of the leaked fluid. For example, the processor 82 may compare the signals obtained by the sensor 42 during operation of the component 12 to a baseline measurement (e.g., taken when the sensor 42 is exposed only to ambient air), and a change (e.g., a change above a threshold, such as a change equal to or greater than about 5, 10, 15, 20, 25, or 50 percent) compared to the baseline measurement may indicate the presence of the leaked fluid. In some embodiments, the processor 82 may also receive and process the signals from the sensor 42 to determine characteristics of the fluid, such as the pressure, the velocity, and/or the composition of the fluid (e.g., based on the characteristics of the waves received at the detector 72). In some embodiments, the processor 82 may provide control signals, such as control signals to the sensor 42 (e.g., to emit the waves) and/or control signals to an actuator to adjust a compressive force (e.g., in a vertical direction) on the packer 22 to adjust the seal against the rod 14. For example, the processor 82 may instruct the actuator to increase the compressive force on the packer 22 in response to detection of the leaked fluid. In some embodiments, the processor 82 may provide control signals to another actuator associated with another component of the mineral extraction system (e.g., another valve; a blowout preventer) in response to detection of the leaked fluid. The controller 80 may include an output device 86 (e.g., display and/or speaker), and the processor 82 may instruct the output device 86 to provide a visual or audible output that indicates the presence or absence of the leaked fluid. For example, the processor 82 may instruct the output device 86 to provide an alarm (e.g., an audible alarm) in response to detection of the leaked fluid.

The controller 82 may be positioned within the housing 18, within a separate support structure coupled to the housing 18, and/or at a location remote from the housing 18. The controller 82 may be part of a distributed controller or control system with one or more controllers (e.g., electronic controllers with processors, memory, and instructions) distributed about the mineral extraction system and in communication with one another to receive and/or to process the signals from sensor 42, to provide an output via the output device 86, and/or to control various components associated with the leak detection system 10.

The processor 82 may include one or more processors configured to execute software, such as software for processing signals and/or controlling the components associated with the leak detection system 10. The memory device 84 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 84 may store processor-executable instructions (e.g., firmware or software) for the processor 82 to execute, such as instructions for processing signals received from the sensor 42 and/or controlling the components related to the leak detection system 10. It should be appreciated that the controller 80 may include various other components, such as a communication device that is capable of communicating data or other information to various other devices (e.g., a remote computing system). Advantageously, the leak detection system 10 may enable real-time leak monitoring and/or may provide a configuration that enables the sensor 42 to obtain accurate and/or reliable measurements, even while the rod 14 moves through the bore 16.

Figure 4:
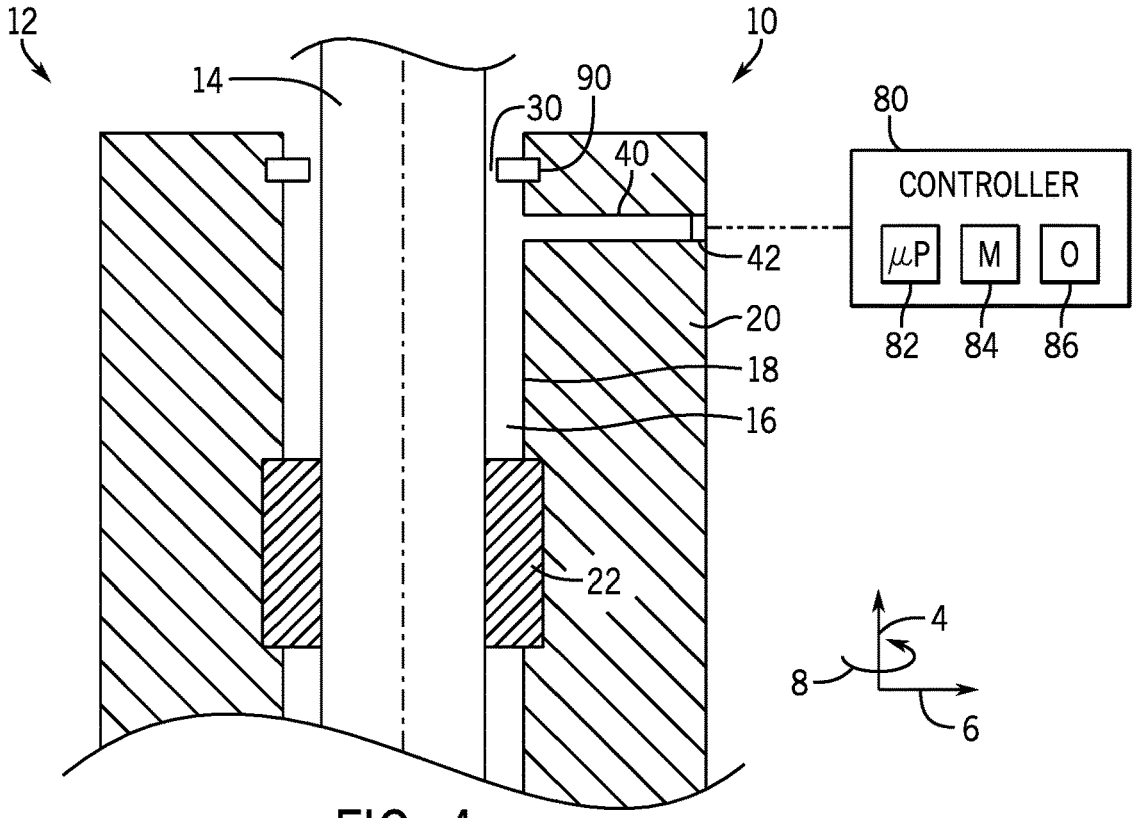
FIG. 4 is a side cross-sectional view of a leak detection system for a component of a mineral extraction system, wherein the leak detection system includes an annular insert, in accordance with another embodiment of the present disclosure.

As noted above, the housing 20 may have various configurations to facilitate diversion of the leaked fluid into the channel 40 and/or detection of the leaked fluid by the sensor 42. For example, in FIG. 4, the leak detection system includes an annular insert 90 and the housing 20 is devoid of the cavity 44 shown in FIG. 1. Instead, the radially-inner wall 18 of the housing 20 extends axially to provide the bore 16 with a generally constant diameter between the packer 22 and the constriction 30. As shown, the channel 40 is positioned axially between the packer 22 and the constriction 30, and the constriction 30 is formed by the annular insert 90 that extends radially-inwardly from the radially-inner wall 18 of the housing 20. The annular insert 90 may be coupled to the radially-inner wall 18 of the housing 20 (e.g., via a threaded interface) and/or may be supported within a groove defined in the radially-inner wall 18 of the housing 20. In operation, the constriction 30 formed by the annular insert 30 may divert the leaked fluid into the channel 40 for detection by the sensor 42 in the manner discussed above with respect to FIGS. 1-3.

Figure 5:
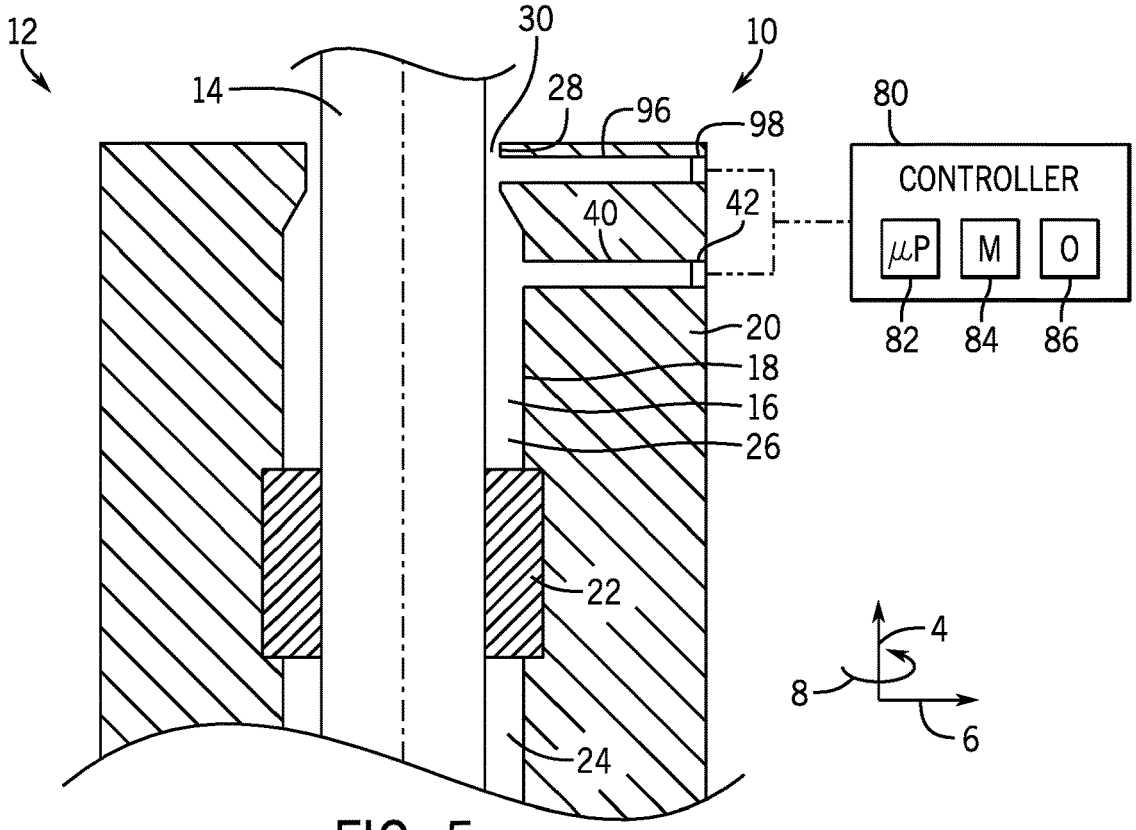
FIG. 5 is a side cross-sectional view of a leak detection system for a component of a mineral extraction system, wherein the leak detection system includes multiple channels, in accordance with another embodiment of the present disclosure.

FIG. 5 illustrates the housing 20 with another configuration that may facilitate diversion of the leaked fluid into the channel 40 and/or detection of the leaked fluid by the sensor 42. As discussed in more detail below, FIG. 5 also illustrates an optional additional channel 96 (e.g., radially-extending channel; flow path; leak detection path) that may be used in the leak detection system 10.

First, in the absence of the additional channel 96, the leak detection system 10 may operate to detect the leaked fluid in a similar manner as discussed above with respect to FIGS. 1-4. As shown, the housing 20 is devoid of the cavity 44 shown in FIG. 1. Instead, the radially-inner wall 18 of the housing 20 extends axially to provide the bore 16 with a generally constant diameter between the packer 22 and the constriction 30. The radially-inner wall 18 of the housing 20 includes the constriction portion 28 that extends radially-inwardly to define the constriction 30. The housing 20 further includes the channel 40 that fluidly couples the bore 16 to the sensor 42, and the channel 40 is positioned axially between the packer 22 and the constriction 30. In operation, the constriction 30 may divert the leaked fluid into the channel 40 to facilitate detection by the sensor 42 in the manner discussed above with respect to FIGS. 1-4.

In some embodiments, the leak detection system 10 may include the additional channel 96 that fluidly couples the bore 16 to an additional sensor 98. While the channel 40 is positioned upstream of the constriction 30 (e.g., closer to the packer 22), the additional channel 96 may be positioned at (e.g., axially aligned with) or downstream of the constriction 30 (e.g., further from the packer 22). In such cases, instead of identifying the leaked fluid by detecting a change in pressure (e.g., as compared to a baseline measurement)

and/or a presence of fluid within the channel 40, the leak detection system 10 may compare a first pressure measured by the sensor 42 to a second pressure measured by the additional sensor 98. A difference between the first and second pressure may indicate the presence of leaked fluid. For example, when the packer 22 adequately seals against the rod 14 to block the fluid from passing into the low pressure region 26 of the bore 16, the first and second pressure may be substantially the same (e.g., within 1, 2, 3, 4, or 5 percent; ambient atmospheric pressure). However, when the packer 22 does not adequately seal against the rod 14 and the leaked fluid flows across the packer 22, the leaked fluid may have a first pressure upstream of the constriction 30 and may have a second pressure that is lower than the first pressure at or downstream of the constriction 30. Accordingly, upon detection of a difference between the first pressure and the second pressure (e.g., a difference above a threshold, such as a difference of equal to or more than approximately 5, 10, 15, 20, 25, 50, or more percent), the processor 82 may determine that the leaked fluid is present in the low pressure region 26 of the bore 16. The difference between the first pressure and the second pressure may also provide an indication of a velocity of the leaked fluid and/or a severity of the leak (e.g., the leak detection system 10 may operate as a venturi flowmeter). As discussed above, the processor 82 may instruct an actuator to increase the compressive force on the packer 22 in response to detection of the leaked fluid and/or may instruct the output device 86 to provide an output (e.g., alarm). The processor 82 may use the difference to determine an amount by which to increase the compressive force on the packer 22 and/or the processor 82 may instruct the output device 86 to provide an output indicative of the velocity of the leaked fluid and/or a severity of the leak.

It should be appreciated that any of the features described above with respect to FIGS. 1-5 may be combined with one another. For example, the bore 16 and the constriction 30 having the configuration shown in FIG. 4 may be formed by shaping the radially-inner wall 18 of the housing 20 (e.g., without a physically separate annular insert 90). Similarly, the annular insert 90 may be utilized in combination with the cavity 44 shown in FIG. 1. Furthermore, the additional channel 96 and the additional sensor 98 may be incorporated into the leak detection system 10 of FIG. 1 or 4 (e.g., positioned at or downstream of the constriction 30).

The leak detection system 10 illustrated in FIGS. 1-5 may be used with various components 12 of the mineral extraction system. For example, the leak detection system 10 may be utilized with various valves, such as a gate valves, ball valves, and the like. In some cases, the leak detection system 10 may be utilized with a PCE stack.

Figure 6:
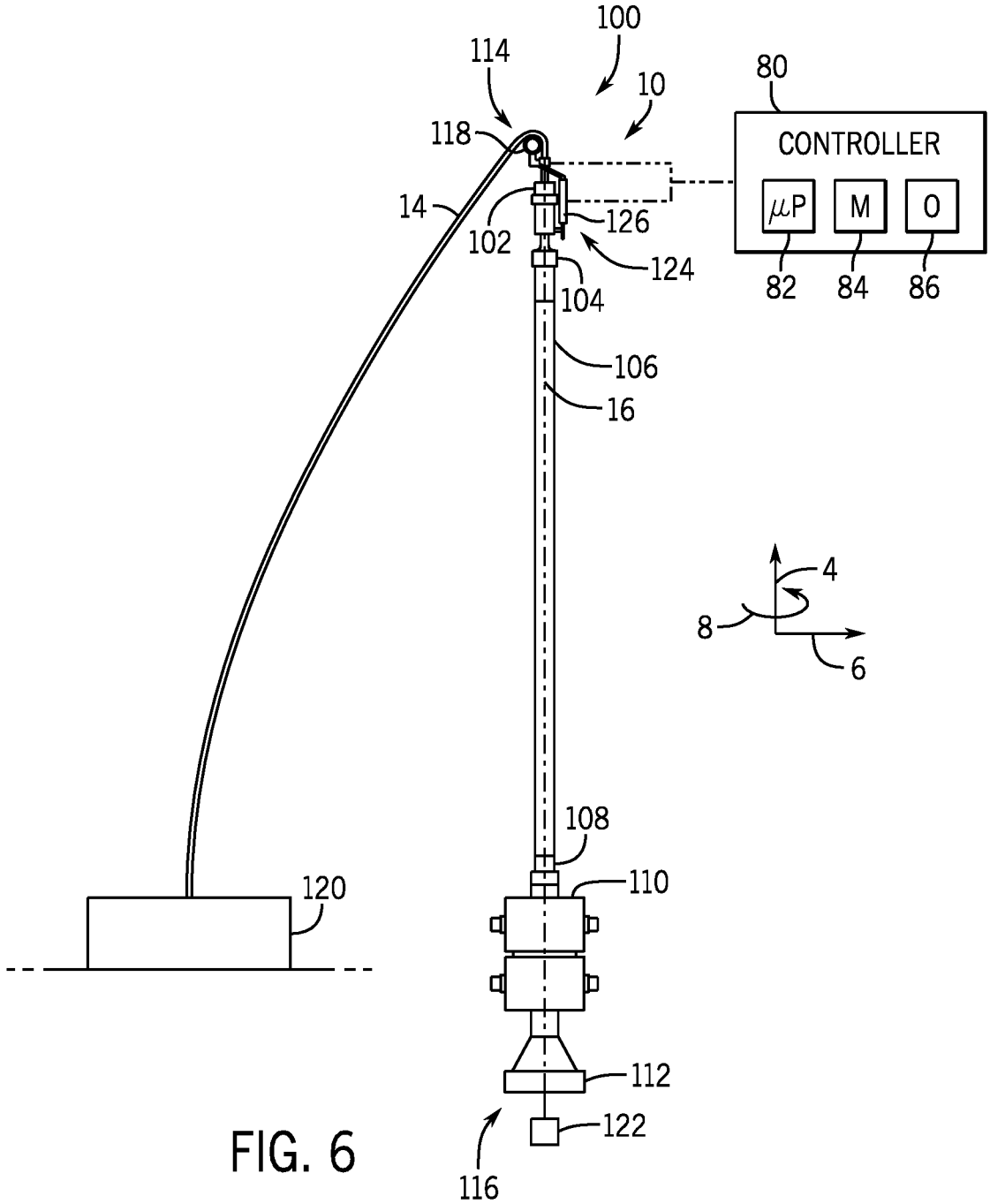
FIG. 6 is a side view of a pressure control equipment (PCE) stack having a leak detection system, in accordance with an embodiment of the present disclosure.

To illustrate, FIG. 6 is a side view of a PCE stack 100 that may include the leak detection system 10 having any of the features described above with respect to FIGS. 1-5. As shown, the rod 14 may extend and move through the bore 16 defined by the various components of the PCE stack 100, such as a stuffing box 102, a tool catcher 104, a lubricator section 106, a tool trap 108, a valve stack 110, and a connector 112 that couples the PCE stack 100 to a wellhead or other structure. These components are annular structures stacked vertically with respect to one another (e.g., coaxial) and extend from a first end 114 to a second end 116 of the PCE stack 100. As shown, the rod 14 extends from the first end 114 of the PCE stack 100 and over a sheave 118 to a winch 120, and rotation of the winch 120 (e.g., a drum or spool of the winch 120) raises and lowers the rod 14 with a tool 122 through the PCE stack 100. It should be appreciated that the PCE stack 100 may include various other components (e.g., cable tractoring wheels to pull the rod 14 through the stuffing box 102, a pump-in sub to enable fluid injection).

In operation, the stuffing box 102 is configured to seal against the rod 14 (e.g., to seal an annular space about the rod 14) to block a flow of fluid across the stuffing box 102. The tool catcher 104 is configured to engage or catch the tool 122 to block the tool 122 from being withdrawn vertically above the tool catcher 104 and/or to block the tool 122 from falling vertically into the wellbore 16. The lubricator section 106 may include one or more annular pipes joined to one another, and the lubricator section 106 may support or surround the tool 122 while it is withdrawn from the wellbore 16. The tool trap 108 is configured to block the tool 122 from falling vertically into the wellbore 16 while the tool trap 108 is in a closed position, and the valve stack 110 may include opposed pipe or shear rams that close to isolate the wellbore.

An actuation assembly 124 may be provided to adjust a compressive force (e.g., in a vertical direction) on a packer of the stuffing box 102 to adjust the seal against the rod 14. For example, movement of the actuation assembly 124 may squeeze the packer vertically, thereby driving the packer radially (e.g., toward the rod 14) to increase a surface area and/or an effectiveness of the seal against the rod 14. The actuation assembly 124 may include an actuator 126 (e.g., an electric, linear actuator; hydraulic actuator; pneumatic actuator) that may generate a force that is applied to a lever and/or a piston that is configured to contact and compress the packer vertically to seal around the rod 14. The actuator 126 may be communicatively coupled to the controller 80 to enable the processor 82 to provide instructions to the actuator 126 in response to the detection of the leaked fluid, as disclosed herein.

Figure 7:
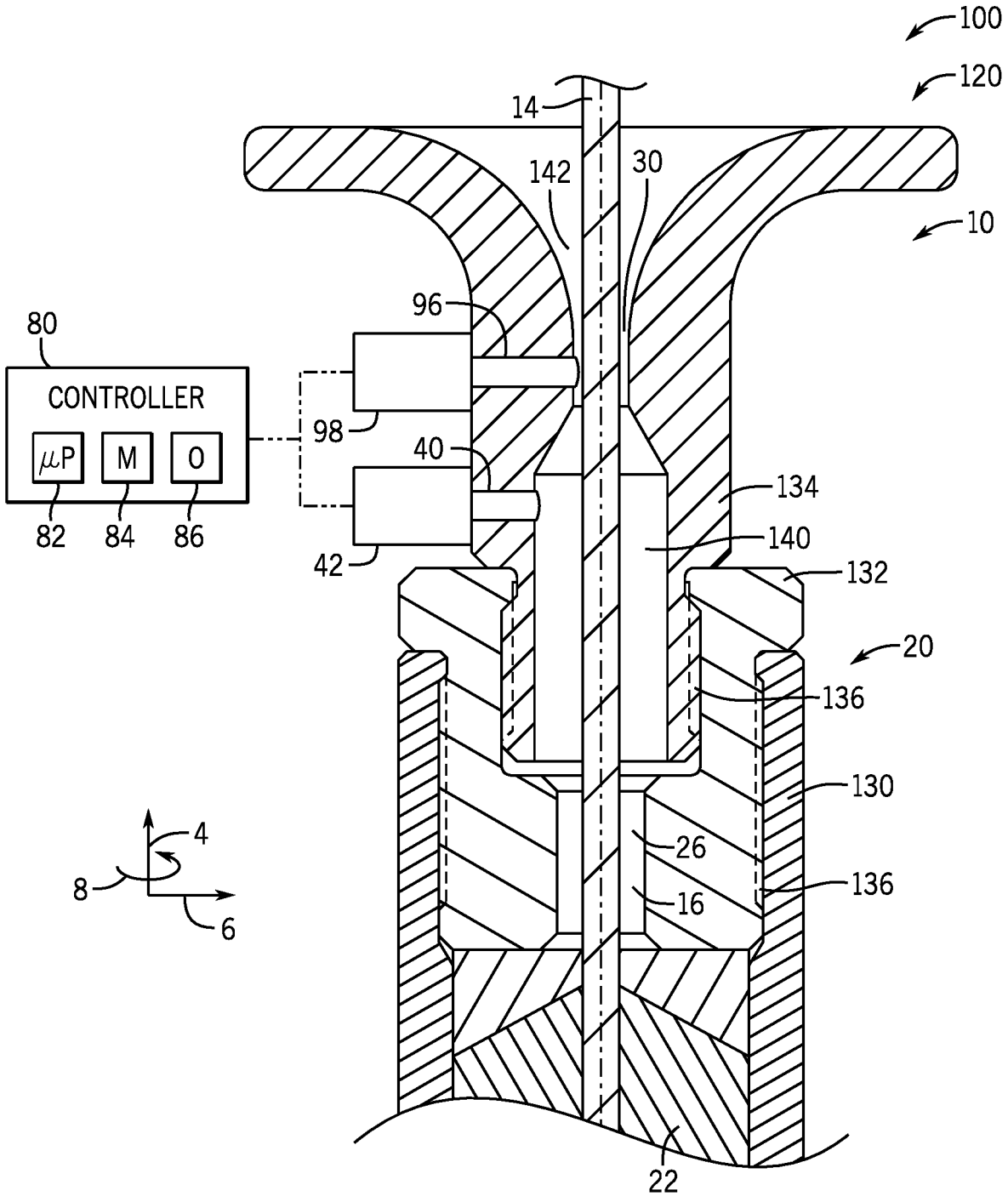
FIG. 7 is a side cross-sectional view of a portion of the PCE stack of FIG. 6, in accordance with an embodiment of the present disclosure.

The leak detection system 10 may be integrated into and/or positioned vertically above the stuffing box 102. To illustrate, FIG. 7 is a side cross-sectional view of a portion the PCE stack 100 of FIG. 6 having the leak detection system 10 integrated into and/or positioned vertically above the stuffing box 102. The illustrated components may be analogous to the component 12 shown in FIGS. 1-5, and it should be appreciated that the PCE stack 100 may include any combination of the features of the leak detection systems 10 disclosed herein.

In the illustrated embodiment, the stuffing box 102 includes the housing 20 supporting the packer 22. The housing 20 includes multiple housing sections coupled to one another. In particular, the housing 20 includes a first annular body 130 (e.g., outer body), a second annular body 132 (e.g., inner body), and a third annular body 134 (e.g., upper body; leak detection body). The bodies 130, 132, 134 may be coupled to one another via respective threaded interfaces 136 or any other suitable technique (e.g., one or more fasteners, such as bolts; integrally formed). The bodies 130, 132, 134 define the bore 16 that receives the rod 14.

The housing 20 (e.g., the third annular body 134 of the housing 20) is shaped to define the constriction 30, the channel 40, and the additional channel 96. As noted above, the additional channel 96 may be optional. In the absence of the additional channel 96, the leaked fluid may be diverted into the channel 40 and/or otherwise detected by the sensor 42 (e.g., via a change in pressure compared to a baseline measurement). When both the channel 40 and the additional channel 96 are present, the leak detection system 10 may compare a first pressure measured by the sensor 42 to a second pressure measured by the additional sensor 98. The difference between the first and second pressure may indicate the presence of leaked fluid. For example, when the packer 22 adequately seals against the rod 14 to block the fluid from passing into the low pressure region 26 of the bore 16, the first and second pressure may be substantially the same (e.g., within 1, 2, 3, 4, or 5 percent; ambient atmospheric pressure). However, when the packer 22 does not adequately seal against the rod 14 and the leaked fluid flows across the packer 22, the leaked fluid may have a first pressure upstream of the constriction 30 (e.g., on a first side 140 of the constriction 30) and may have a second pressure that is lower than the first pressure at or downstream of the constriction 30 (e.g., at or on a second side 142 of the constriction 30). Accordingly, upon detection of a difference between the first pressure and the second pressure (e.g., a difference above a threshold, such as a difference of equal to or more than approximately 5, 10, 15, 20, 25, 50, or more percent), the processor 82 may determine that the leaked fluid is present.

As discussed above, the processor 82 may instruct the actuator 126 (FIG. 6) to increase the compressive force on the packer 22 and/or may instruct the output device 86 to provide an output (e.g., alarm) in response to detection of the leaked fluid. The difference between the first pressure and the second pressure may also provide an indication of a velocity of the leaked fluid and/or a severity of the leak (e.g., the leak detection system 10 may operate as a venturi flowmeter). The processor 82 may use the difference to determine an amount by which to increase the compressive force on the packer 22 and/or the processor 82 instruct the output device 86 to provide an output indicative of the velocity of the leaked fluid and/or a severity of the leak.

Figure 8:
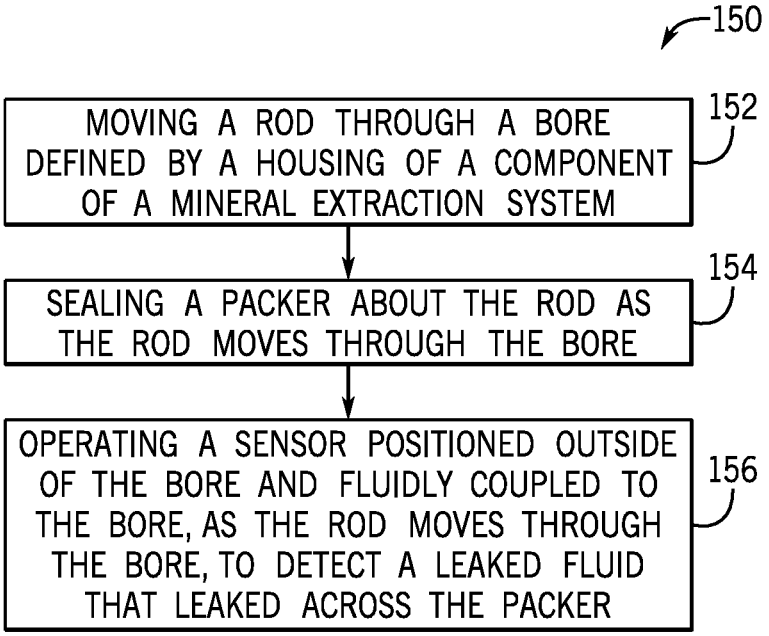
FIG. 8 is a method of operating a leak detection system for a component of a mineral extraction system, in accordance with an embodiment of the present disclosure.

FIG. 8 is a flow chart of a method 150 of operating the leak detection system 10, in accordance with an embodiment of the present disclosure. The method 150 disclosed herein includes various steps represented by blocks. It should be noted that at least some steps of the method 150 may be performed as an automated procedure by a system, such as the controller 80. Although the flow chart illustrates the steps in a certain sequence, it should be understood that the steps may be performed in any suitable order and certain steps may be carried out simultaneously, where appropriate. Additionally, steps may be added to or omitted from of the method 150.

The method 150 may include moving the rod 14 through the bore 16 defined by the housing 20, in step 152. The method 150 may include sealing the packer 22 about the rod 14 as the rod 14 moves through the bore 16 defined by the housing 20, in step 154. The method 150 may also include operating the sensor 42 that is positioned outside of the bore 16 and that this fluidly coupled to the channel 40 to detect the leaked fluid as the rod 14 moves through the bore 16 defined by the housing 20, in step 156.

Additional details and/or steps of the method 150 may be understood with reference to the discussion of FIGS. 1-7. For example, the method 150 may further include operating the additional sensor 98 that is positioned outside of the bore 16 and that is fluidly coupled to the additional channel 96 to detect the leaked fluid as the rod 14 moves through the bore 16 defined by the housing 20. The method 150 may include the various processing and control steps (e.g., processing data from the sensor 42 and/or the additional sensor 98 to detect the leaked fluid; providing control signals to the actuator 126 and/or the output device 86). As discussed above, the constriction 30 within the bore 16 may facilitate detection of the leaked fluid, such as by diverting the leaked fluid into the channel 40 and/or by providing a pressure differential across the constriction 30 that can be detected by the sensor 42 and the additional sensor 98, for example. Thus, the leaked fluid may be detected in various ways, such as by directly detecting the leaked fluid within the channel 40 and/or by detecting changes in pressure (e.g., as compared to a baseline measurement and/or based on a difference between the first pressure at the sensor 42 and the second pressure at the additional sensor 98) caused by the leaked fluid. The method 150 may be utilized to detect the leaked fluid in any of a variety of components 12 of the mineral extraction system, including any of a variety of valves, the stuffing box 102 of the PCE stack 100, or the like.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A leak detection system, comprising:

an annular housing that defines a bore;

an annular packer disposed within the annular housing and configured to seal against a rod that moves through the bore;

a constriction within the bore;

a channel extending radially-outwardly from the bore and positioned upstream of the constriction;

a sensor positioned outside of the bore and fluidly coupled to the channel, wherein the sensor is configured to detect a leaked fluid within the bore; and an actuator configured to compress the annular packer to adjust the seal against the rod in response to the sensor detecting the leaked fluid within the bore.

2. The leak detection system of claim 1, wherein the constriction is formed by a radially-inner wall of the annular housing.

3. The leak detection system of claim 1, wherein the constriction is formed by an annular insert coupled to the annular housing.

4. The leak detection system of claim 1, wherein the sensor comprises a flow sensor, a pressure sensor, an acoustic sensor, an optical sensor, a mechanical sensor, or any combination thereof.

5. The leak detection system of claim 1, wherein the channel is positioned between the annular packer and the constriction along a longitudinal axis of the bore.

6. The leak detection system of claim 5, comprising a cavity within the bore, wherein the cavity is a region of an expanded diameter within the bore and is positioned at an intersection between the longitudinal axis of the bore and a respective longitudinal axis of the channel.

7. The leak detection system of claim 1, comprising an additional channel extending radially-outwardly from the bore and an additional sensor positioned outside of the bore and fluidly coupled to the additional channel.

8. The leak detection system of claim 7, wherein the additional channel is axially aligned with the constriction.

9. The leak detection system of claim 7, comprising one or more processors, wherein the one or more processors are configured to receive pressure data from the sensor and the additional sensor, to process the pressure data, and to determine that the leaked fluid is present within the bore in response to identifying a difference between a first pressure at the sensor and a second pressure at the additional sensor.

10. The leak detection system of claim 1, comprising one or more processors, where in the one or more processors are configured to receive sensor data from the sensor, to process the sensor data, and to determine that the leaked fluid is present within the bore in response to identifying a difference between the sensor data and baseline data.

11. A component of a mineral extraction system, comprising:

an annular housing that defines a bore;

an annular packer configured to seal against a rod that moves through the bore;

a constriction within the bore;

a channel extending radially-outwardly from the bore;

a sensor positioned outside of the bore and fluidly coupled to the channel, wherein the sensor is configured to detect a leaked fluid that leaked across the annular packer; and one or more processors, wherein the one or more processors are configured to receive sensor data from the sensor, to process the sensor data, to determine that the leaked fluid is present in response to identifying a difference between the sensor data and baseline data, and to instruct an actuator to compress the annular packer to adjust the seal against the rod in response to determining that the leaked fluid is present.

12. The component of claim 11, wherein the channel is positioned between the annular packer and the constriction along a longitudinal axis of the bore.

13. The component of claim 11, comprising an additional channel extending radially-outwardly from the bore and an additional sensor positioned outside of the bore and fluidly coupled to the additional channel.

14. The component of claim 13, wherein the additional channel is axially aligned with the constriction.

15. The component of claim 11, wherein the component comprises a stuffing box of a pressure control equipment stack.

16. The component of claim 11, wherein the component comprises a valve, and the rod comprises a reciprocating or rotating valve stem of the valve.

17. A method of operating a leak detection system for a component of a mineral extraction system, comprising:

moving a rod through a bore defined by an annular housing;

sealing an annular packer about the rod as the rod moves through the bore defined by the annular housing;

operating a sensor to detect a leaked fluid that leaked across the annular packer as the rod moves through the bore defined by the annular housing, wherein the sensor is positioned outside of the bore and is fluidly coupled to a channel that extends radially-outwardly from the bore at an axial location between a constriction within the bore and the annular packer; and compressing the annular packer to adjust the seal against the rod in response to determining that the leaked fluid is present.

18. The method of claim 17, operating an additional sensor to detect the leaked fluid that leaked across the annular packer as the rod moves through the bore defined by the annular housing, wherein the additional sensor is positioned outside of the bore and is fluidly coupled to an additional channel that extends radially-outwardly from the bore at a respective location that is axially aligned with the constriction.

19. The method of claim 17, diverting the leaked fluid into the channel using the constriction to facilitate detection of the leaked fluid by the sensor.

* * * * *